US011841144B2

(12) United States Patent
Jang

(10) Patent No.: US 11,841,144 B2
(45) Date of Patent: Dec. 12, 2023

(54) COOKING APPLIANCE

(71) Applicant: LG Electronics Inc., Seoul (KR)

(72) Inventor: Jaebong Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 161 days.

(21) Appl. No.: 17/144,833

(22) Filed: Jan. 8, 2021

(65) Prior Publication Data

US 2021/0215346 A1 Jul. 15, 2021

(30) Foreign Application Priority Data

Jan. 10, 2020 (KR) ..... 10-2020-0003579

(51) Int. Cl.
*F24C 15/02* (2006.01)
*F24C 15/32* (2006.01)

(52) U.S. Cl.
CPC ..... *F24C 15/022* (2013.01); *F24C 15/32* (2013.01)

(58) Field of Classification Search
USPC ..... 125/273 R
See application file for complete search history.

(56) References Cited

U.S. PATENT DOCUMENTS 3,894,214 A 7/1975 Staples
4,163,443 A * 8/1979 Peterson ..... 126/197
4,862,870 A * 9/1989 Fox ..... F24C 14/02 126/197
5,918,589 A * 7/1999 Valle et al. ..... 126/193
6,079,756 A * 6/2000 Phillips ..... E05B 47/0002 292/229
6,302,098 B1 10/2001 Smith
10,138,669 B2 11/2018 Vanini et al.
2005/0121919 A1* 6/2005 Smock ..... F24C 15/022 292/110

(Continued)

FOREIGN PATENT DOCUMENTS

CN 206091628 U 4/2017
EP 1860382 11/2007

(Continued)

OTHER PUBLICATIONS

EP Extended European Search Report in European Appln. No. 21150684.5, dated Jun. 7, 2021, 9 pages.

(Continued)

*Primary Examiner* — Steven B McAllister
*Assistant Examiner* — John E Bargero
(74) *Attorney, Agent, or Firm* — Fish & Richardson P.C.

(57) ABSTRACT

Proposed is a cooking appliance having a function capable of manually opening a door even when a closed state of the door is maintained. The cooking appliance includes: a main body having a cooking chamber defined therein; a door mounted rotatably to the main body; and a latch module provided in the main body and controlling the opening and closing of the door, wherein the latch module includes: a latch installed rotatably at an end thereof, an elastic body installed at a side of the latch and forcing the latch to be rotated in one direction by applying an elastic force to the latch; a driving part installed at a side of the elastic body and supplying power to the latch; a cam provided at a side of the driving part; and a lever bracket having an end thereof connected to the latch.

18 Claims, 12 Drawing Sheets

(56) References Cited

U.S. PATENT DOCUMENTS

| | | | | |
|---|---|---|---|---|
| 2006/0232077 | A1 | 10/2006 | Courter et al. | |
| 2007/0240699 | A1 | 10/2007 | Welch et al. | |
| 2020/0284440 | A1* | 5/2020 | DeYoung | F24C 15/023 |

FOREIGN PATENT DOCUMENTS

| | | |
|---|---|---|
| EP | 3557137 | 10/2019 |
| KR | 1020190120676 | 10/2019 |

OTHER PUBLICATIONS

Office Action in Chinese Appln. No. 202110023508.3, dated Apr. 28, 2023, 19 pages (with English translation).

* cited by examiner

COOKING APPLIANCE

CROSS REFERENCE TO RELATED APPLICATION

The present application claims priority to Korean Patent Application No. 10-2020-0003579, filed Jan. 10, 2020, the disclosure of which is incorporated herein by reference in its entirety.

TECHNICAL FIELD

The present disclosure relates to a cooking appliance having a function enabling a door to be manually opened even when a closed state of the door is maintained.

BACKGROUND

Generally, a cooking appliance is an appliance in which food is cooked by heat of a heating source.

The cooking appliance may include: a main body having a cooking chamber; at least one heating source provided in the main body; and a door connected to the main body to open and close the cooking chamber.

In this way, a cooking appliance, such as an oven or microwave, has a rectangular exterior shape as a whole, and the cooking chamber located inside the cooking appliance has a shape open in the front thereof, and the door is normally provided in the front of the cooking chamber.

In addition, there are various methods in which the door is opened, but a method in which a hinged door is opened and closed by rotating relative to a rotational axis thereof is widely used. Such a type of a door is normally provided with a handle provided thereon which a user can grip or a groove formed therein.

Meanwhile, to improve the quality of the use of the door of the cooking appliance, a function to automatically open the door has been added. In some cooking appliances, a self-cleaning function is also added to make the cleaning of a cooking chamber easier, and a door is prevented from opening during self-cleaning.

The self-cleaning is a function that allows the inside of the cooking chamber to be heated to a high temperature so that food attached to the inner wall of the cooking chamber is burned or is soaked in hot water vapor, so that the food can be conveniently removed when cleaning.

Accordingly, to prevent accidents, the door of the cooking appliance is desired to be securely closed during the self-cleaning operation of the cooking appliance.

However, in the conventional cooking appliance having such a self-cleaning function, there is a problem in that the door cannot be opened when a failure occurs or electricity is cut off during the self-cleaning operation. Furthermore, the automatic opening of the door and the function of keeping the door locked or closed are performed in each mode, and the structure of the cooking appliance is complicated, thereby making manufacturability and service difficult.

Even if the automatic opening or locking function of the door is applied in this way, the door may be desired to be manually opened and closed for user convenience, and the function of opening the door and the function of keeping the door locked and closed may be desired to be performed in one module.

SUMMARY

Accordingly, the present disclosure has been made keeping in mind the above problems occurring in the related art, and the present disclosure is intended to propose a cooking appliance which has a function allowing a door of the cooking appliance to be manually and simply opened during failure or first installation of the cooking appliance.

In addition, the present disclosure is intended to propose a cooking appliance, in which the automatic opening and closing of the door of the cooking appliance, the maintaining of the closed state of the door, and the manual opening of the door may be performed by one module.

Furthermore, the present disclosure is intended to propose a cooking appliance, in which a latch may be moved by an operation bar at the outside, and a door of the cooking appliance may be easily opened even when electricity is cut off.

In order to achieve the above objectives, particular implementations of the present disclosure provide a cooking appliance that includes a main body, a door, and a latch assembly. The main body defines a cooking chamber configured to receive food to be cooked. The door is configured to rotate relative to the main body and to open and close the cooking chamber of the main body. The latch assembly is positioned at the main body and configured to allow the door to open and close the cooking chamber. The latch assembly includes a latch, an elastic body, a driver, a cam, and a lever. The elastic body is configured to apply an elastic force to the latch to thereby rotate the latch in a first direction. The driver is configured to apply a driving force to the latch. The driver is configured to drive the latch to overcome the elastic force and rotate in a second direction that is opposite to the first direction. The cam is configured to transfer the driving force from the driver to the latch. The lever bracket is connected to the latch and configured to transfer an external force to the latch to thereby rotate the latch.

In some implementations, the cooking appliance can optionally include one or more of the following features. The main body may include an inner housing defining the cooking chamber, a main body panel positioned at an end part of the inner housing, and a main body air outlet defined at an end part of the main body panel and configured to discharge air from the main body to an outside of the main body. An upper end of the lever bracket is positioned to correspond to a height of the main body air outlet. The lever bracket may include a mounting piece coupled to the latch, and an extension piece extending from an end of the mounting piece at an angle relative to the mounting piece. The mounting piece may be mounted to a surface of the latch, and the extension piece may be perpendicular to the mounting piece. The lever bracket may include a holding end part extending from an end of the extension piece and having a width smaller than a width of the extension piece. The main body may include an inner housing defining the cooking chamber, a main body panel positioned at an end part of the inner housing, and a main body air outlet defined at an end part of the main body panel and configured to discharge air from the main body to an outside of the main body. The holding end part of the lever bracket may be positioned to correspond to a height of the main body air outlet. The main body may include an inner housing defining the cooking chamber, and an outer housing surrounding the inner housing. The holding end part of the lever bracket extends through an upper surface of the inner housing and is positioned at least partially above the upper surface of the inner housing. The main body may include an inner housing defining the cooking chamber, and an outer housing surrounding the inner housing. An upper end of the lever bracket extends through an upper surface of the inner housing and is positioned at least partially above the upper surface of the inner housing. The latch may include an upper end part, a lower end part that is spaced vertically and horizontally apart from the upper end part, and an inserting connection part that connects between the upper end part and the lower end part. The upper end part and the lower end part may be positioned parallel to each other. The inserting connection part may be angled relative to the upper end part and the lower end part. The upper end part and the lower end part may be positioned at different vertical heights. The latch may define a hook groove at an end of the lower end part. The hook grove is configured to receive a pin of the door. The hook groove may define a holding surface configured to hold the pin of the door therein or configured to allow the pin of the door to contact and slide on the holding surface. The holding surface may include a locking surface defined at an inner side of the hook groove, and a removal inclination surface defined at an exit side of the hook groove. The latch may include a removal prevention step that protrudes from an end of the removal inclination surface and that is configured to restrict the pin of the door from being removed from the hook groove. The latch may include a movement-prevention protrusion that protrudes from a surface of the inserting connection part and that is configured to restrict an upward movement of the latch. The latch may define a mounting protrusion. The mounting piece of the lever bracket may define a protrusion hole that corresponds to the mounting protrusion of the latch and configured to couple the mounting protrusion of the latch. The latch may define a mounting hole. The mounting piece of the lever bracket may define a through hole configured to align with the mounting hole and vertically receive a fastener through the mounting hole and the through hole. The lever bracket may be configured to move and guide the latch to rotate based on the operation bar being inserted into the main body from an outside of the main body. The operation bar may be configured to engage with an upper end of the lever bracket.

In order to achieve the above objectives, according to one aspect of the present disclosure, there is provided a cooking appliance, in which a latch is configured to be rotated by a force applied from the outside. Accordingly, a user may manually open a door even in the lock mode of the door.

In addition, in the cooking appliance of the present disclosure, a separate lever bracket coupled to the latch may be provided, and a user may move the lever bracket through an air flow hole. Accordingly, the latch may be easily moved by the user at the outside, so the door may be easily opened.

In the cooking appliance of the present disclosure, the upper end of the lever bracket may be installed to have a height corresponding to the height of a main body air outlet.

In the cooking appliance of the present disclosure, a holding end part of the lever bracket may be installed to have a height corresponding to the height of the main body air outlet.

Additionally, in the cooking appliance of the present disclosure, the operation bar being in contact with the upper end of the lever bracket and allowing the latch to be moved may be provided. Accordingly, the manipulation of the rotation of the latch may be easily performed outside the cooking appliance.

Meanwhile, in the cooking appliance of the present disclosure, a handle, a holding piece, and an inclined holding extension piece may be formed in the operation bar. Accordingly, the lever bracket may be easily manipulated through a gap between the door and a main body in the front of the cooking appliance.

The cooking appliance of the present disclosure may be configured to include: the main body having a cooking chamber defined therein, the cooking chamber allowing food to be cooked therein; the door mounted rotatably to the main body and opening and closing the cooking chamber; and a latch module provided in the main body and controlling the opening and closing of the door.

The latch module may be configured to include: the latch installed rotatably at an end thereof, an elastic body provided at a side of the latch and forcing the latch to be rotated in one direction by applying an elastic force to the latch; a driving part provided at a side of the elastic body and supplying power to the latch such that the latch is rotated in an opposite direction of the rotating direction of the latch by overcoming the elastic force applied to the latch by the elastic body; a cam provided at a side of the driving part and transmitting the power of the driving part to the latch; and the lever bracket having an end thereof connected to the latch and transmitting an external force to the latch such that the latch is rotated by the external force.

The lever bracket may be configured to include: a mounting piece coupled to a surface of the latch, and an extension piece formed by extending from an end of the mounting piece and having a predetermined angle relative to the mounting piece.

The mounting piece may be mounted to the upper surface of the latch, and the extension piece may be formed to be perpendicular to the mounting piece.

The holding end part may be formed on the upper end of the extension piece by extending upward therefrom, the holding end part having a width smaller than the width of the extension piece.

The latch may be configured to include an upper end part and a lower end part having heights different from each other and formed at positions spaced apart from each other, and an inserting connection part formed between the upper end part and the lower end part and connecting the front end of the upper end part to the rear end of the lower end part.

In addition, the upper end part and the lower end part may be formed to be parallel to each other.

The inserting connection part may be formed to incline and connect the upper end part and the lower end part to each other, the upper end part and the lower end part having heights different from each other.

A hook groove in which a pin of the door is received may be formed in the front end of the lower end part by being recessed toward a side of the front end.

A holding surface may be formed on a surface of the hook groove, the pin being held in or sliding on the holding surface by being in contact therewith.

The holding surface may include a locking surface formed on the inner side of the hook groove and a removal inclination surface formed on the exit side of the hook groove.

A removal prevention step may be formed on an end of the removal inclination surface by protruding therefrom, the removal prevention step being configured to prevent the pin of the door from being removed from the hook groove.

A movement-prevention protrusion may be formed on a surface of the inserting connection part by protruding upward therefrom, the movement-prevention protrusion being configured to prevent the upward movement of the latch.

A mounting protrusion and a protrusion hole may be formed on the latch and in the mounting piece, respectively, the mounting protrusion and the protrusion hole being configured to have shapes corresponding to each other and to be coupled to each other.

A mounting hole and a through hole through which a fastener vertically passes may be formed through the latch and the mounting piece, respectively.

The lever bracket may be moved by the operation bar inserted into the main body from the outside thereof and may guide the latch such that the latch is rotated.

The operation bar may be configured to include: the handle grasped by a user's hand; the holding piece formed at a position spaced apart from the handle and interfering with the holding end part of the lever bracket; and the holding extension piece formed between the handle and the holding piece and connecting the handle to the holding piece such that the handle and the holding piece are integrated with each other.

An end part groove may be formed in a surface of the holding piece by being recessed toward the inner side thereof, the end part groove allowing the end of the holding end part to be received therein.

The handle and the holding piece may be formed to be parallel to each other, and the holding extension piece may be formed to incline, so the holding extension piece may connect the handle and the holding piece to each other which have different heights.

The holding piece may be formed at a position lower than the handle.

The handle may be configured to include a main piece having a predetermined area, and edges formed by extending by being bent perpendicularly to the opposite ends of the main piece therefrom.

The cooking appliance of the present disclosure has the following effects.

First, according to the cooking appliance of the present disclosure, the door may be configured to be opened by the latch rotated by a force applied from the outside. Accordingly, a user at the outside may manually open the door even in a lock mode of the door without the supply of electricity.

Second, according to the cooking appliance of the present disclosure, the separate lever bracket coupled to the latch may be provided, so a user may move the lever bracket through an air flow hole. That is, a user at the outside may easily move the latch by horizontally moving the lever bracket exposed to the upper side of the inside of the main body. Accordingly, when required, the door may be easily opened outside the cooking appliance.

Third, according to the cooking appliance of the present disclosure, the operation bar may be provided to move the latch by being in contact with the lever bracket. Accordingly, a user outside the cooking appliance may easily rotate the latch, and thus the opening of the door may be easily performed.

Fourth, according to the cooking appliance of the present disclosure, the handle, the holding piece, and the inclined holding extension piece may be formed in the operation bar. Accordingly, it may be easy to manipulate the lever bracket through the gap between the door and the main body in the front of the cooking appliance.

Fifth, according to the cooking appliance of the present disclosure, the lever bracket may include the mounting piece coupled to a surface of the latch and the extension piece having a predetermined angle relative to the mounting piece, wherein the holding end part may be formed on the upper end of the extension piece by extending upward therefrom, the holding end part having a width smaller than the width of the extension piece. Accordingly, only the holding end part may be exposed to the upper side of a partitioning piece of the main body of the cooking appliance, so the cut portion of the partitioning piece may be small and the weight of the lever bracket may be decreased.

Sixth, according to the cooking appliance of the present disclosure, the removal prevention step may be formed on the end of a hook part of the latch. Accordingly, the pin of the door in contact with the removal inclination surface may be prevented from being automatically removed from the removal inclination surface such that the door is opened.

Seventh, according to the cooking appliance of the present disclosure, the movement-prevention protrusion may be formed on the upper surface of the latch. Accordingly, the vertical movement of the latch may be prevented by a latch bracket such that the excessive vertical movement of the latch is prevented, thereby preventing noise and malfunction.

Eighth, in the cooking appliance of the present disclosure, the mounting protrusion and the protrusion hole may be formed on the latch and in the lever bracket, respectively, the mounting protrusion and the protrusion hole being configured to have shapes corresponding to each other and to be coupled to each other. Accordingly, the lever bracket may be easily mounted to the precise position of the latch and the mounting of the lever bracket thereto may be stable.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Hereinbelow, a cooking appliance of the present disclosure will be described in detail with reference to the accompanying drawings.

Figure 1:
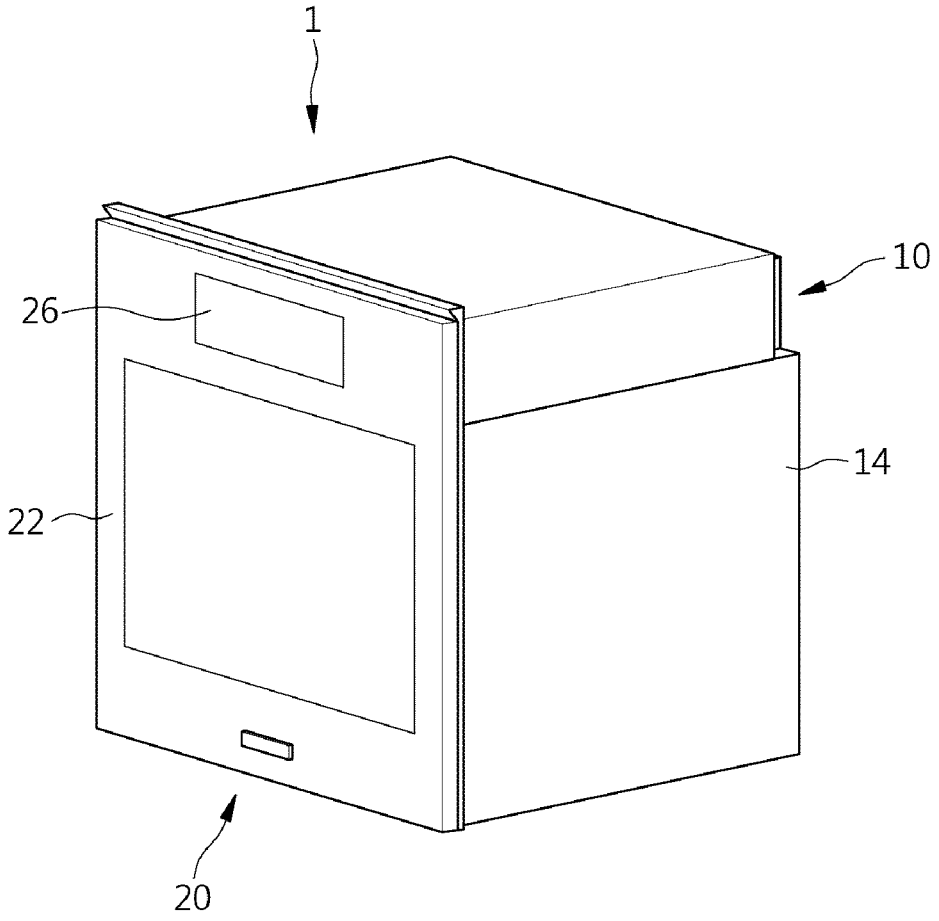
FIG. 1 is a perspective view illustrating the configuration of a cooking appliance of the present disclosure according to an exemplary embodiment.
Figure 2:
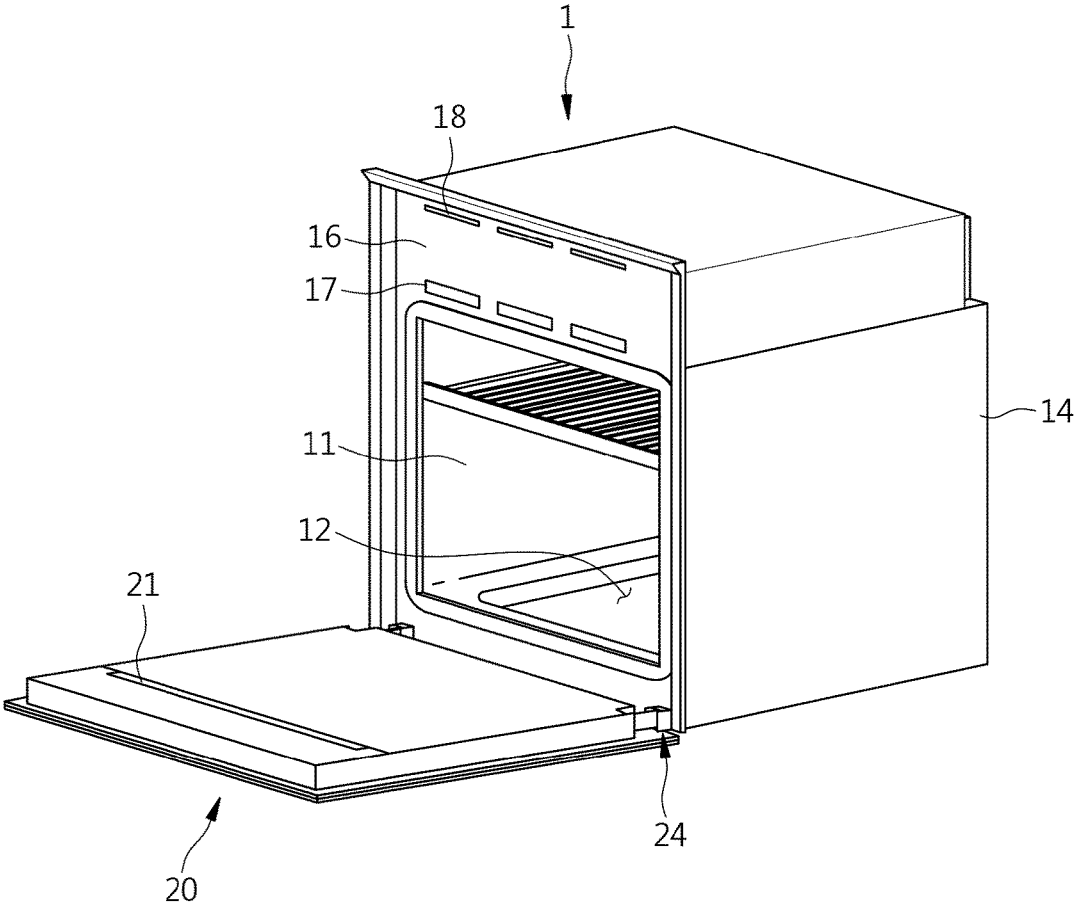
FIG. 2 is a perspective view illustrating the opened state of a door in the cooking appliance of the present disclosure.

FIGS. 1 and 2 illustrate the perspective views of the cooking appliance of the present disclosure according to an exemplary embodiment. That is, FIG. 1 is a perspective view illustrating the closed state of a door in the cooking appliance, and FIG. 2 is a perspective view illustrating the opened state of the door in the cooking appliance.

As illustrated in these drawings, the cooking appliance 1 of the present disclosure according to the embodiment may include a main body 10 in which various parts are received.

A cooking chamber 12 in which food is received to be cooked may be formed inside the main body 10.

The main body 10 may include an inner housing 11 defining the cooking chamber 12, and an outer housing 14 located outside the inner housing 11 and surrounding the inner housing 11.

The inner housing 11 and the outer housing 14 may be installed by being spaced apart by a predetermined gap from each other. Multiple parts may be installed between the inner housing 11 and the outer housing 14, or a path for air flow may be formed therebetween.

A main body panel 16 may be provided on the front end part of the inner housing 11. The main body panel 16 may be coupled to the front end part of the inner housing 11, or may be formed to be integrated with the front end part thereof.

The door 20 may be mounted to the main body 10 such that the door is rotated by a hinge mechanism 24, and may open and close the cooking chamber 12. For example, the hinge mechanism 24 may be connected to the lower end of the door 20 and may function as a central shaft for opening and closing the door 20.

To minimize temperature rise caused by heat supplied to the cooking chamber 12, air outside the door 20 may be allowed to flow into the door 20.

Accordingly, the door 20 may include a door air outlet 21 allowing the air flowing inside the door 20 to be discharged therethrough. The main body 10 may include a main body air inlet 17 allowing the air discharged through the door air outlet 21 to be introduced thereto. The main body air inlet 17 may be formed in the main body panel 16.

In addition, air introduced to the main body 10 through the main body air inlet 17 may flow inside the main body 10, and then may be discharged to the outside of the main body 10 through a main body air outlet 18. The main body air outlet 18 may be formed in the main body panel 16. That is, the main body air outlet 18 may be formed through an upper end part of the main body panel 16 in a front-to-rear direction thereof as illustrated in FIG. 2. Air flowing inside the main body 10 may be discharged to the outside of the main body 10 through the main body air outlet 18.

Accordingly, the main body air outlet 18 allowing the air introduced into the main body 10 to be discharged to the outside may be formed in the upper end part of the main body panel 16.

In addition, although not shown in detail, the door 20 may further include a controller. Although the position of the controller is not limited, the controller may be located at the upper part of the door 20. When the door 20 is closed, the controller may be located to face a portion of the main body panel 16 located at the upper side of the cooking chamber 12.

The controller may include at least one of a display part and a manipulation part. For example, the controller may allow the operation information of the cooking appliance 1 to be displayed and/or allow a user's operation command to be input.

The door 20 may include a front panel 22. The controller may be mounted to the rear surface of the front panel 22.

The front panel 22 may constitute the exterior of the front surface of the door 20. Although not limited, the front panel 22 may be made of glass, and may constitute the entire exterior of the front surface of the door 20.

Meanwhile, although not shown in detail, the door 20 may further include at least one middle panel arranged at the rear of the front panel 22 by being spaced apart therefrom, and a rear panel located at the rear of the middle panel.

The at least one middle panel may act as an insulation panel blocking heat of the cooking chamber 12 from being transferred to the outside. The rear panel may cover the cooking chamber 12 when the door is closed.

The middle panel and the rear panel may also be made of glass. Accordingly, a user may check the cooking status of food contained in the cooking chamber 12, with the door 20 closed.

A display window 26 may be provided on the front panel 22, the display window displaying the operation information of the cooking appliance 1. That is, the display window 26 having a predetermined size may be formed on an upper end part of the front panel 22, and a display device (not shown) may be installed at the rear side of such a display window 26.

Figure 3:
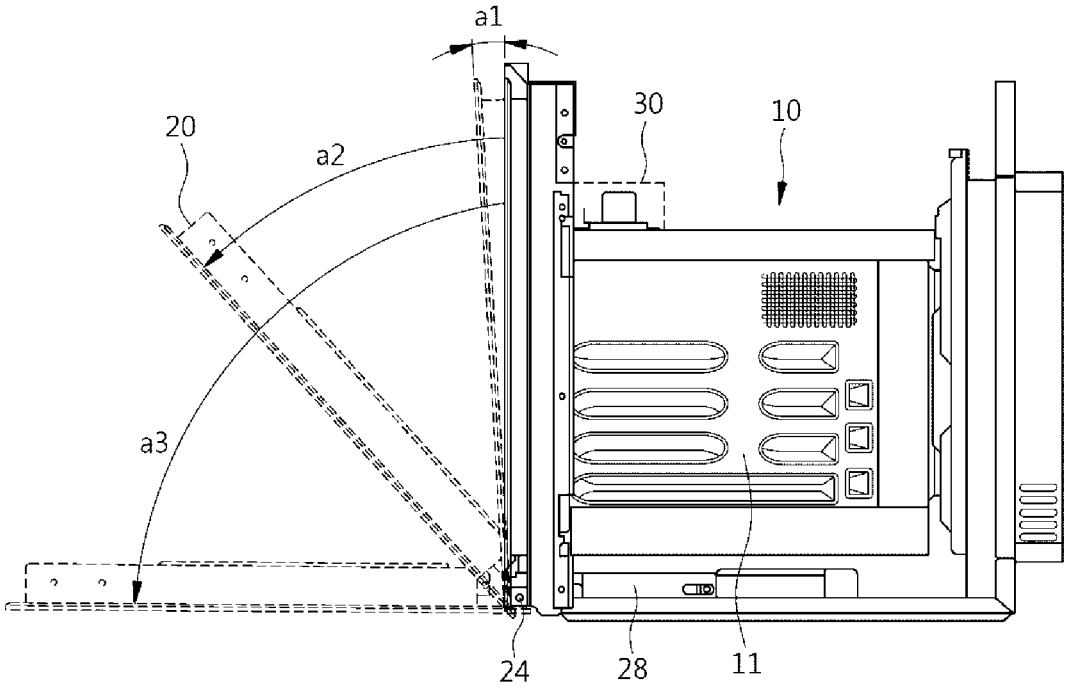
FIG. 3 is a right side view illustrating the configuration of the cooking appliance from which an outer housing is removed according to the embodiment of the present disclosure.

FIG. 3 illustrates the right side view of the cooking appliance 1 from which the outer housing 14 is removed.

As illustrated in the drawing, the inner housing 11 may be provided inside the main body 10 and may allow the cooking chamber 12 located in the inner housing to have predetermined space.

Various parts necessary for the operation of the cooking appliance may be provided on the upper, lower, rear, and side parts of the main body 10.

The door 20 may be provided rotatably relative to the hinge mechanism 24 located horizontally on a lower end part of the door. Accordingly, the door 20 may be opened by a front and downward rotation thereof relative to the main body 10, and may be closed by a rear and upward rotation thereof relative to the main body.

The area of the door 20 may just be an area through which the front of the cooking chamber is opened or closed, and may be an area through which the front of space above the cooking chamber in addition to the cooking chamber is covered as illustrated in the drawing.

A latch module 30 may be provided at a side on the main body 10, the latch module allowing the closed state of the door 20 to be maintained, the door 20 to be manually opened and closed, the door 20 to be automatically opened, and the door 20 to be held and locked such that the door 20 is not opened manually.

The latch module 30 may be installed on the upper part of the main body 10, and the front end part of the latch module 30, that is, a hook part 51 to be described below may protrude further forward than the front surface of the main body 10

The latch module 30 may be installed on a position different from the position described above. That is, the latch module 30 may be installed on a side of the upper part of the door 20, or on the opposite sides of the upper part of the door 20.

Although not shown in detail, a hinge module 28 in which a spring, a damper, and a sub-spring are installed may be connected to the front lower part of the main body 10 and the lower part of the door 20.

The spring may apply an elastic force to the door 20 in the rear and upward rotating direction of the door 20, that is, in the closing direction of the door. Accordingly, the spring may prevent the door 20 from being opened hard when the door 20 is opened in a front and downward direction.

In addition, when the door 20 is opened, the damper may damp the rotational force of the door 20 and allow the door 20 to be opened slowly. In some implementations, the damper may supply a damping force only when the door is opened, or the damping force may be supplied in both the opening and closing directions of the door. Furthermore, the damper may supply the damping force to the door in all sections of the rotation angle of the door in which the door opens and closes, or may supply the damping force to the door in some sections of the range of the rotation angle.

The damper may reduce the opening force of the door in a predetermined opening angle section of the door, and may not supply the damping force to the door in a section outside the opening angle section. That is, the damper may be configured to operate in an opening angle section corresponding to the section of a2 to a3 of FIG. 3.

A damping start angle a2 at which the damping force starts to be applied to the door while the door is opened may be 35±5°, and the sub-spring may apply an elastic force to the door in the opening direction of the door 20. The range of the opening angle of the door at which the sub-spring applies the elastic force to the door in the opening direction of the door may be 0° to a1.

Figure 4:
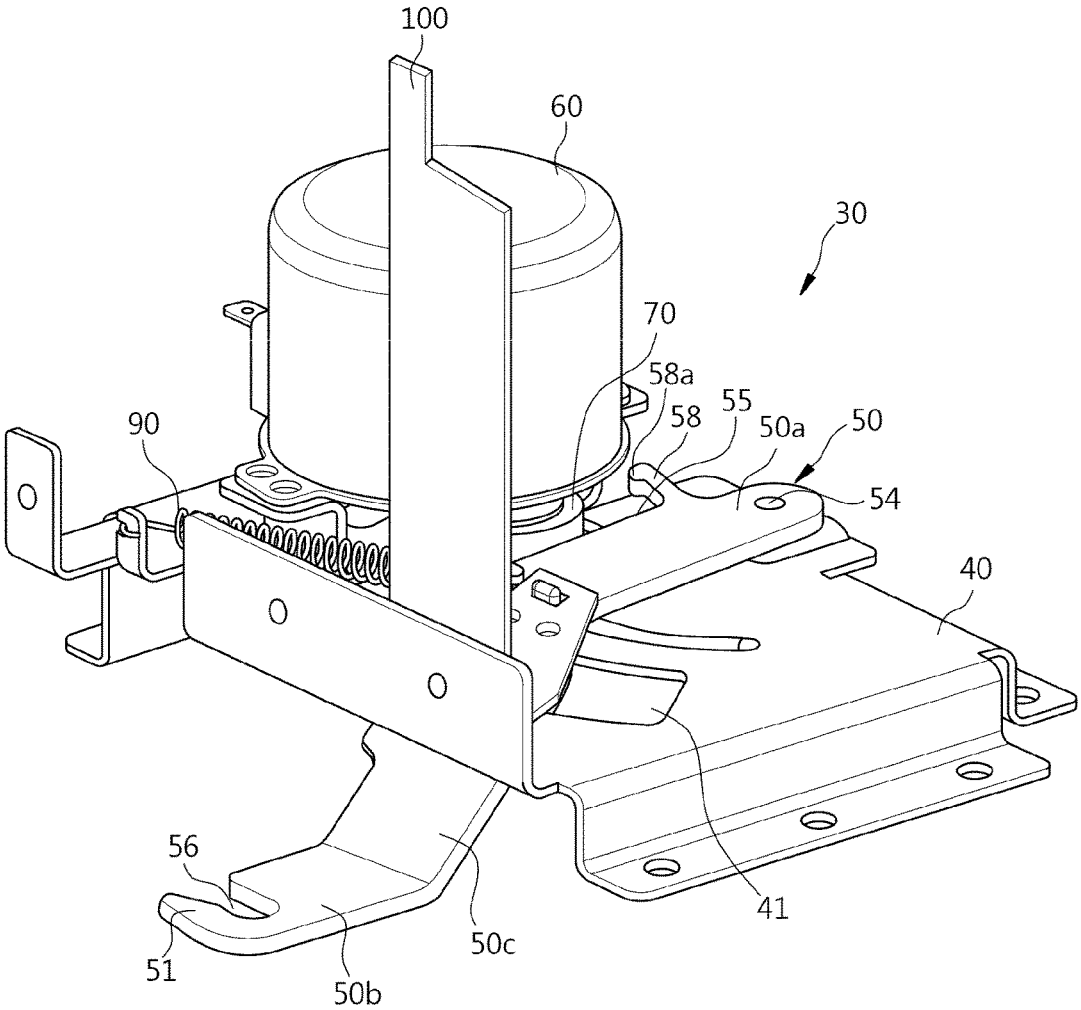
FIG. 4 is a perspective view illustrating the detailed configuration of a latch module according to the embodiment of the present disclosure.
Figure 5:
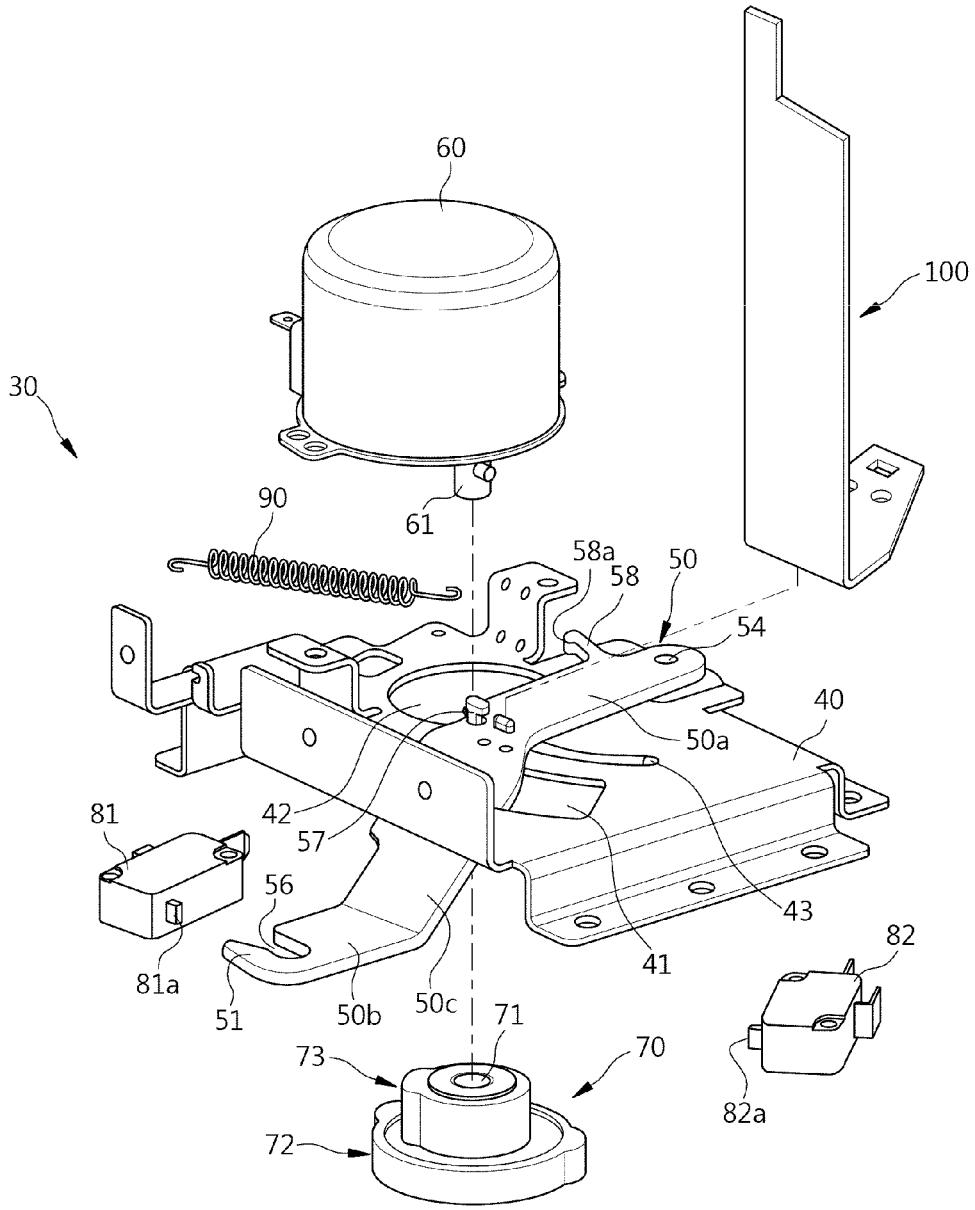
FIG. 5 is an exploded perspective view illustrating the detailed configuration of the latch module according to the embodiment of the present disclosure.
Figure 6:
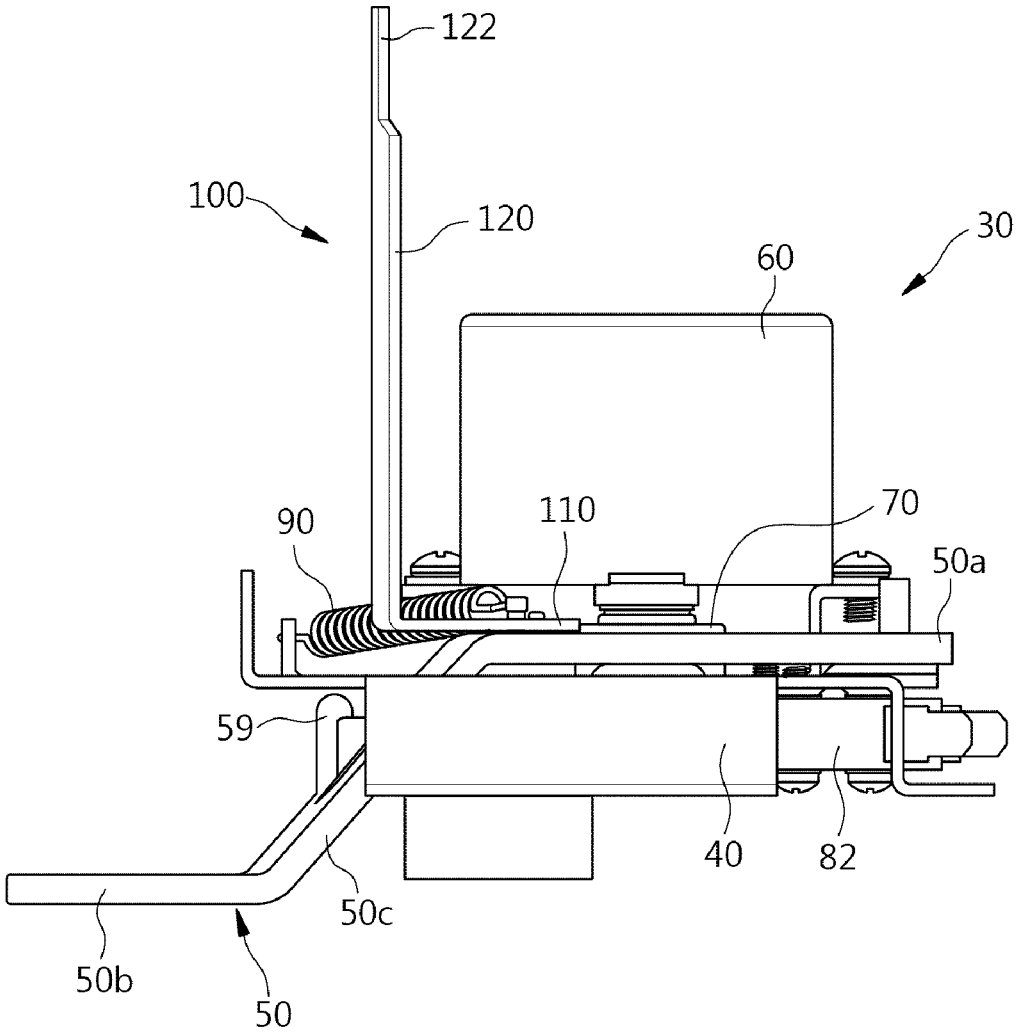
FIG. 6 is a right side view illustrating the detailed configuration of the latch module according to the embodiment of the present disclosure.

Each of FIGS. 4 to 6 illustrates an example of the latch module 30. That is, FIGS. 4 and 5 illustrate a perspective view and an exploded perspective view of the latch module 30, respectively, and FIG. 6 illustrates the right side view of the latch module 30.

As illustrated in these drawings, the latch module 30 may include a latch bracket 40 constituting an entire foundation thereof. The latch bracket 40 may be made of sheet metal.

As illustrated in the drawings, the latch bracket 40 configured as a metal plate having a shape of a rectangular flat plate may bend upward or downward in edges thereof. Accordingly, the latch module 30 may be fixed to other parts, and various parts may be mounted to the latch bracket 40.

The latch bracket 40 may include a cam receiving hole 42 supplying space receiving a cam 70 which is a power transmission part and an arc hole 41 limiting the rotation section of a latch 50 mounted rotatably to the latch bracket 40.

The latch 50 may be rotatably mounted to the latch bracket 40. The latch 50 may be rotatably mounted to the latch bracket at an end (a rear end) of the latch.

The latch 50 may have a structure in which a long metal flat plate is bent, and a pivot shaft part 54 may be provided on the rear end part of the latch 50, the pivot shaft part being the center of the rotation of the latch 50 relative to the latch bracket 40.

A pivot shaft (not shown) may be mounted to the pivot shaft part 54, so the latch 50 may be rotatably mounted to the latch bracket 40.

The rear part of the latch 50 including the pivot shaft part 54 may be arranged on the latch bracket 40.

In addition, a contact surface 55 and an interference extension part 58 may be provided on a side surface of the latch 50 (a left side surface of the latch in FIGS. 4 and 5) arranged on the latch bracket 40, wherein the contact surface may be in contact with the latch-position adjustment profile 73 of the cam 70, and the interference extension part 58, in some cases, may interfere with the cam 70 and allow the operation error of the latch 50 to be kinematically compensated.

The interference extension part 58 may extend laterally (to a left side in FIGS. 4 and 5) from the contact surface 55, so the contact surface 55 and the interference extension part 58 may have an L shape as a whole (when viewed from the rear upper side of the latch).

An inserting connection part 50*c* may be provided on the middle part of the latch 50 by bending front and downward, the inserting connection part passing through the arc hole 41 of the latch bracket 40.

The arc hole 41 may have a size to cover the rotation trajectory of the latch 50, with the inserting connection part 50*c* inserted into the arc hole 41.

In the latch bracket 40, a sliding surface 43 having a shape of an arc may be provided at a position closer to the pivot shaft part 54 than the arc hole 41, the sliding surface supporting the rotation of the latch 50.

The sliding surface 43 may have a shape protruding convexly by a predetermined height upward from the surface of the latch bracket 40 (an upper surface of the latch bracket in FIGS. 4 and 5), and may be in contact with the lower surface of the latch 50. Accordingly, the sliding surface 43 may prevent the surface of the latch bracket 40 and the latch 50 from being in direct contact with each other and prevent friction therebetween.

The front end part of the inserting connection part 50*c* may bend forward and horizontally extend forward, and the hook part 51 may be provided on the front end part of the latch 50.

The hook part 51 may hold or release a pin of the door 20 (not shown), and may control the opening or closing of the door such that the opened or closed state of the door 20 is maintained.

The latch 50 may be installed rotatably at the rear end thereof and may be forced to be rotated in one direction by an elastic body. That is, the elastic body configured as a spring to be described below may force the latch 50 to be rotated in one direction by applying an elastic force to the latch 50.

A holding protrusion 57 holding the end part of the spring 90 which is the elastic body may be provided on the latch 50. The first end part of the spring 90 may be held by and fixed to the holding protrusion 57, and the second end part of the spring 90 may be fixed to the latch bracket 40.

The holding protrusion 57 may be formed by protruding from the upper surface of the latch 50, but may be formed vertically through the latch 50 to have a hole shape.

Accordingly, the spring 90 may pull the latch 50 to the spring.

The spring 90 may be arranged at a left side of the latch 50 (in FIGS. 4 and 5), and may apply an elastic force to the latch 50 such that the latch is rotated leftward (in FIGS. 4 and 5).

The cam 70 may be rotatably installed at the left side of the latch 50 (in FIGS. 4 and 5).

The cam 70 may be installed on the side of a driving part to be described below, and may transmit the power of the driving part to the latch 50.

A shaft hole 71 which is the center of the rotation of the cam 70 may be formed vertically through the cam, and thus the cam 70 may have a vertical rotating shaft.

The cam 70 may be installed at a position at which the cam passes through the cam receiving hole 42 of the latch bracket 40. Accordingly, the upper part of the cam 70 may be exposed to the upper part of the latch bracket 40, and the lower part of the cam 70 may be exposed to the lower part of the latch bracket 40.

The cam 70 may be in contact with the contact surface 55 of the latch 50 described above, and may include the latch-position adjustment profile 73 adjusting the position of the latch 50 in the rotation direction of the latch 50, and a switch push profile 72 pushing switches 81 and 82 to be described later or releasing the pushing thereof.

The latch-position adjustment profile 73 may be provided on the upper part of the cam, and the switch push profile 72 may be provided on the lower part of the cam.

In addition, with the cam 70 mounted to the latch bracket 40, the latch-position adjustment profile 73 may be exposed to the upper part of the latch bracket 40 and be in contact with the contact surface 55 of the latch 50, and the switch push profile 72 may be exposed to the lower part of the latch bracket 40 and may push the switches 81 and 82 mounted to the lower part of the latch bracket 40 or release the pushing thereof.

The cam 70 may be made of a synthetic resin having high strength and heat resistance, for example, poly phenylene sulfide (PPS). Accordingly, the contact wear of the cam 70 may be minimized and the stability of the cam may be secured in the environment of the cooking appliance having high temperature.

The driving part may be provided on a side of the elastic body, the driving part supplying power to the latch in a direction opposite to the direction in which the elastic body applies the elastic force to the latch.

The driving part may be configured as a motor 60 and may be a part supplying power to the latch such that the latch 50 is rotated in the opposite direction of the applying direction of the elastic force by overcoming the elastic force applied to the latch by the elastic body.

Accordingly, the cam 70 may be driven to be rotated by the motor 60 which is the driving part. According to the embodiment of the present disclosure, the cam 70 may be directly connected to the rotating shaft 61 of the motor 60.

The motor 60 may be a motor which can be rotated bidirectionally, that is, clockwise and counterclockwise.

The motor 60 may be fixed on the upper part of the latch bracket 40 such that the rotating shaft 61 is directed downward, and the rotating shaft 61 may be inserted into the shaft hole 71 of the cam 70.

A first switch 81 and a second switch 82 may be mounted to the lower part of the latch bracket 40. The first switch and the second switch may be microswitches having a button 81*a* and a button 82*a*, respectively.

The buttons 81*a* and 82*a* of the switches installed on the bracket may protrude to approximately face the center of the cam 70.

The buttons 81*a* and 82*a* may be arranged to have an angle between 90° and less than 180° relative to the center of the rotation of the cam, and may be arranged at the same distance from the center of the rotation of the cam. Preferably, the angle may be 110° to 160°, and about 120° may be appropriate.

A lever bracket 100 may be provided on the latch 50.

As illustrated in the drawings, the lever bracket 100 may be coupled to the upper surface of the latch 50 such that the lever bracket has a predetermined vertical length.

The upper end of the lever bracket 100 may protrude to a side higher than the inner housing 11 after passing through the upper surface thereof. The upper end of such a lever bracket 100 may interfere with an operation bar 200 to be described below. That is, the upper end of the lever bracket 100 may be formed by protruding to a side higher than the upper end of the inner housing 11. The lever bracket 100 may function to rotate the latch 50 by transmitting the force of the operation bar 200 to be described below to the latch 50.

Accordingly, the lever bracket 100 may have an end (a lower end) thereof connected to the latch 50 and transmit an external force (a user's force) to the latch 50 such that the latch 50 is rotated by the external force.

Meanwhile, the upper end of the lever bracket 100 may be installed to have a height corresponding to the height of the main body air outlet 18. That is, the upper end of the lever bracket 100 may be installed to have the same height as the height of the main body air outlet 18 or to protrude at least to a side upper than the height of the main body air outlet 18.

This is intended to allow an end of the operation bar 200 and the upper end of the lever bracket 100 to interfere with each other by being in contact with each other when the end of the operation bar 200 to be described below is inserted into the main body through the main body air outlet 18.

Figure 7:
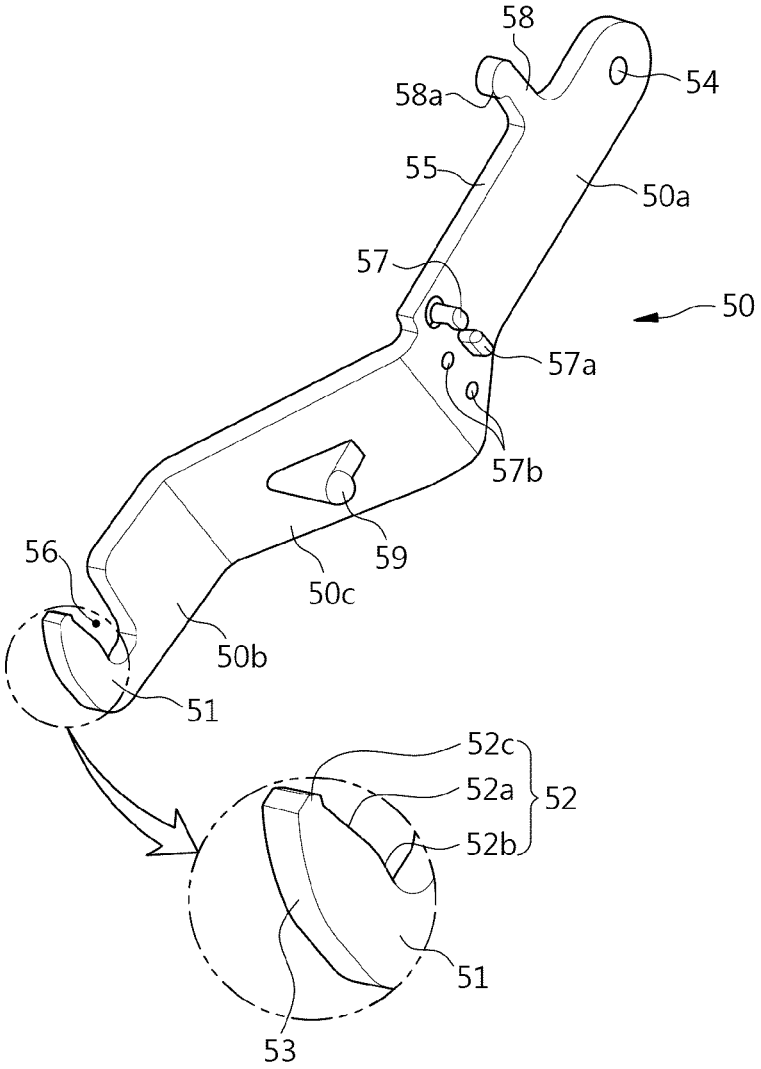
FIG. 7 is a perspective view illustrating the configuration of a latch according to the embodiment of the present disclosure.

FIG. 7 is a perspective view illustrating the configuration of the latch 50.

Accordingly, as illustrated in the drawing, the latch 50 may include an upper end part 50*a* and a lower end part 50*b* which have height different from each other and are formed at positions spaced apart from each other.

In addition, the inserting connection part 50*c* may be formed between the upper end part 50*a* and the lower end part 50*b*, the inserting connection part connecting the front end of the upper end part 50*a* to the rear end of the lower end part 50*b*.

As illustrated in FIG. 7, the upper end part 50*a* and the lower end part 50*b* may be configured to be parallel to each other.

In addition, as illustrated in FIG. 7, the inserting connection part 50*c* may be formed to incline and connect the upper end part 50*a* and the lower end part 50*b* to each other which have heights different from each other.

The hook part 51 provided on the front end part of the latch 50, that is, on the end part of the front thereof may have an open shape in a side of the hook part, specifically, in a direction of the left side of the latch 50. Accordingly, a hook groove 56 being open to the left side (in FIG. 7) may be formed in the front end of the latch 50.

Specifically, the hook groove 56 receiving the pin of the door 20 may be formed in the front end of the lower end part 50*b* by being recessed to a side (to a right side). Accordingly, the pin of the door 20 (not shown) may be received and held in the hook groove 56.

That is, although not shown in detail, the pin may be formed to be vertically integrated with the upper end part of the door 20 as in conventional technologies. When such a pin is received in the hook groove 56, the door 20 may be locked, and when the pin is removed from the hook groove 56, the door 20 may be configured to be opened.

A holding surface 52 may be formed on a surface of the hook groove 56 (a front surface thereof in FIG. 7), the pin of the door 20 being held in or sliding on the holding surface by being in contact therewith.

The holding surface 52 may include a locking surface 52*b* formed on the inner side of the hook groove 56, and a removal inclination surface 52*a* formed on the exit side of the hook groove 56 (a left side thereof in FIG. 7).

More specifically, the holding surface 52 in which the rear surface of the pin of the door 20 (not shown) is held may be formed on the inner side of the hook part 51. That is, the holding surface 52 may be formed on the outer surface of the hook groove 56 (a surface of the front side in FIG. 7).

The holding surface 52 may include the removal inclination surface 52*a* and the locking surface 52*b*.

The removal inclination surface 52*a* may be arranged closer to the left side of the holding surface 52, and the locking surface 52*b* may be arranged closer to the right side of the holding surface 52. That is, as illustrated in FIG. 7, the locking surface 52*b* may be arranged at the inner side (the right side in FIG. 7) of the hook groove 56 than the removal inclination surface 52*a*.

Due to the rotation of the latch 50 relative to the pivot shaft part 54, the rear surface of the pin (not shown) may be located at a manual lock position of the door by being in contact with the removal inclination surface 52*a*. In this case, the removal inclination surface 52*a* may have an inclining surface inclining leftward in the opening direction of the door 20. That is, the removal inclination surface 52*a* may be formed to incline such that the width of the hook groove 56 increases leftward as illustrated in FIG. 7.

In addition, due to the rotation of the latch 50 relative to the pivot shaft part 54, the rear surface of the pin (not shown) may be located at a locking position of the door by being in contact with the locking surface 52*b*. In this case, the locking surface 52*b* may incline leftward in the closing direction of the door or may have a surface perpendicular to the opening direction of the door.

That is, as illustrated in the drawing, the width of the inner side (the right side) of the hook groove 56 at which the locking surface 52*b* is located may have the same size in the right and left sides of the inner side or the locking surface 52*b* may incline such that the width of the hook groove 56 increases toward the outer side of the hook groove.

Accordingly, when the pin of the door 20 is received on the locking surface 52*b*, the pin may not be automatically removed leftward therefrom.

The connecting portion of the removal inclination surface 52*a* to the locking surface 52*b* may have a smooth curved shape, so when the rear surface of the pin (not shown) in contact with the removal inclination surface 52*a* slides toward the locking surface 52*b* due to the rotation of the latch 50, the sliding may be efficiently performed.

Particularly, such a movement of the latch 50 may be performed by the elastic force of the spring which is the elastic body, so as the sliding is efficiently performed, the movement of the latch may be more efficiently performed.

Meanwhile, a removal prevention step 52*c* may be formed on an end of the holding surface 52. That is, the removal prevention step 52*c* may be formed on the end of the removal inclination surface 52*a* by protruding rearward therefrom, the removal prevention step being configured to prevent the pin of the door 20 from being removed from the hook groove.

Accordingly, the removal prevention step 52*c* is intended to prevent the door 20 from being automatically opened unless a pulling force having predetermined strength is applied to the door when the pin of the door 20 is located at the manual lock position of the door by being in contact with the removal inclination surface 52*a*.

An inserting inclination surface 53 may be formed on a surface of the hook part 51 opposite to the removal inclination surface 52*a*. The inserting inclination surface 53 may have an inclining surface that inclines leftward in the closing direction of the door when the latch 50 is located at the manual lock position.

In addition, when the latch is located at the manual lock position, such an inserting inclination surface 53 may be in contact with the surface of the pin of the door (not shown). That is, due to the removal inclination surface 52*a* and the inserting inclination surface 53, the hook part 51 may have a shape gradually getting thinner toward the end part (a left side) thereof, that is, a pointed shape.

The contact surface 55 being in contact with the cam 70 may be provided on the side surface (the left side surface) of the latch 50. The contact surface 55 may be arranged at the right side of the center of the rotation of the cam 70.

The interference extension part 58 may be formed on an end part (a rear part) of the contact surface 55 by extending outward (leftward) therefrom.

Accordingly, the interference extension part 58 and the contact surface 55 may form the L shape as a whole when viewed from a position above or below the latch 50. The contact surface 55 and the interference extension part 58 may be arranged to have a shape surrounding the cam 70.

An interference part 58*a* may be formed on the interference extension part 58 in a side direction to the extending direction thereof, the interference part facing the cam 70 and in some cases, interfering with the cam 70 by being in contact with the surface of the cam. The interference part 58*a* may be formed by protruding from the interference extension part 58 to the left side to the extending direction thereof, so other portions of the interference extension part 58 except for the interference part 58*a* may not interfere with the cam 70.

When the latch 50 is rotated in the left direction, the interference part 58*a* may be in contact with the surface of the cam 70. Furthermore, when the latch 50 is rotated in the right direction, the interference part 58*a* may be moved in a direction away from the cam.

In some implementations, the interference extension part 58 are not manufactured integrally with the body part of the latch 50, and may be assembled therewith after being manufactured as a separate part. In some implementations, the interference extension part 58 do not move as a rigid body together with the body part of the latch 50. When the cam 70 pushes the interference extension part 58 such that the interference extension part is rotated in the left direction during the movement (rotation) of the latch 50, and while the latch 50 is located at a position, such a pushing force may be transmitted to the body part of the latch 50.

In addition, the movement of the latch 50 by the cam 70 is also disclosed in the prior art, so a further detailed description thereof is omitted here.

A movement-prevention protrusion 59 may be formed on a surface of the inserting connection part 50*c* by protruding upward therefrom, the movement-prevention protrusion being configured to prevent the upward movement of the latch 50. That is, as illustrated in FIG. 7, the inserting connection part 50*c* may have a shape gradually decreasing in height forward. The movement-prevention protrusion 59 may be formed on the upper surface of the inserting connection part 50*c* inclining in such a way by protruding by a predetermined height upward therefrom.

The movement-prevention protrusion 59 is intended to prevent the vertical movement of the latch 50. That is, since the latch 50 may be mounted to the latch bracket 40 to be rotated relative to the rear end of the latch, the vertical movement of the latch may occur. During the vertical movement of the latch 50, the movement-prevention protrusion 59 may be in contact with the lower surface of the latch bracket 40 and may prevent the latch from moving upward.

Accordingly, as illustrated in FIG. 7, the movement-prevention protrusion 59 may have an outer surface protruding round to have an upper surface having a hemispherical shape.

As illustrated in FIG. 7, the holding protrusion 57, a mounting protrusion 57*a*, and a mounting hole 57*b* may be formed in the latch 50. That is, each of the holding protrusion 57, the mounting protrusion 57*a*, and the mounting hole 57*b* may be formed in the upper surface of the front end of the upper end part 50*a*.

The holding protrusion 57 may be a part by which an end of the spring 90 which is the elastic body is held.

The mounting protrusion 57*a* may function to guide the installation position of a mounting piece 110 of the lever bracket 100 to be described below for the coupling of the lever bracket to the latch 50. As illustrated in FIG. 7, the mounting protrusion 57*a* may protrude by a predetermined height upward from the upper surface of the upper end part 50*a*.

The mounting protrusion 57*a* may be formed to have a shape corresponding to the shape of a protrusion hole 112 of the lever bracket 100 to be described below and may be received in the protrusion hole 112.

The mounting hole 57*b* may be formed vertically through the upper end part 50*a*, and may be a part through which a fastener passes. The mounting hole 57*b* may include at least two mounting holes.

The pivot shaft part 54 through which the central shaft (not shown) of the rotation of the latch 50 passes may be formed vertically through the rear end of the latch 50.

Figure 8:
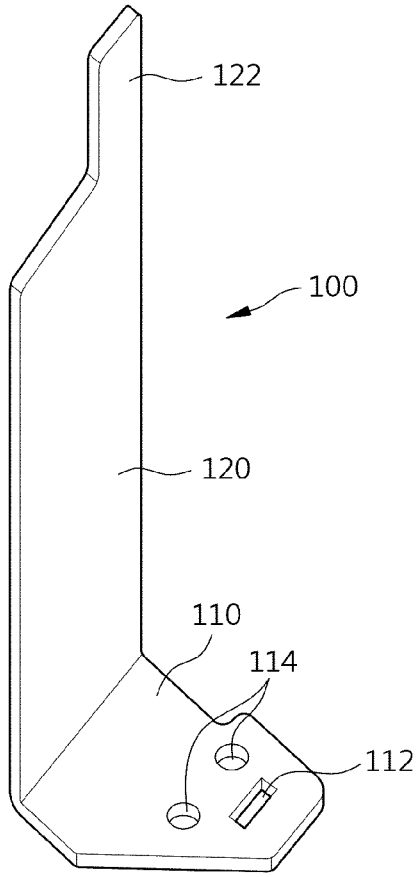
FIG. 8 is a perspective view illustrating the configuration of a lever bracket according to the embodiment of the present disclosure.

FIG. 8 illustrates a perspective view of the lever bracket 100.

The lever bracket 100 may function to transmit the external force to the latch 50 such that the latch is rotated by the operation bar 200 to be described below. That is, the lever bracket 100 may be moved by the operation bar 200 inserted into the main body 10 from the outside thereof and may guide the latch 50 such that the latch is rotated.

As illustrated in FIG. 8, the lever bracket 100 may include the mounting piece 110 coupled to the surface of the latch 50 and an extension piece 120. That is, the lever bracket 100 may include the mounting piece 110 coupled to the upper surface of the latch 50 and the extension piece 120 formed by extending from the end of the mounting piece 110 (a left end thereof in FIG. 8) and having a predetermined angle to the mounting piece 110.

More specifically, the mounting piece 110 may be mounted to the upper surface of the latch 50, and the extension piece 120 may be formed to be perpendicular to the mounting piece 110.

Each of the mounting piece 110 and the extension piece 120 may be configured as a flat plate having a predetermined thickness.

A holding end part 122 may be formed on the upper end of the extension piece 120 by extending upward therefrom, the holding end part having a width smaller than the width of the extension piece 120. The holding end part 122 is intended such that the upper end of the extension piece 120 passes through a partitioning piece located inside the main body 10 and is easily exposed to the upper side of the partitioning piece.

That is, the extension piece 120 may protrude to the upper side of the partitioning piece after passing therethrough such that the extension piece 120 passes through the inside of the main body 10 and interferes with the operation bar 200 to be described below. To expose the entirety of the upper end of such an extension piece 120 to the upper side of the partitioning piece, the structure of the partitioning piece may be cut larger. Accordingly, the holding end part 122 having the width smaller than the width of the extension piece 120 may be formed.

Meanwhile, the holding end part 122 of the lever bracket 100 may be installed to have a height corresponding to the height of the main body air outlet 18. That is, the holding end part 122 of the lever bracket 100 may be installed to have the same height as the height of the main body air outlet 18, or to protrude at least to a side upper than the height of the main body air outlet 18.

This is intended such that the end of the operation bar 200 and the holding end part 122 of the lever bracket 100 interfere with each other by being in contact with each other when the operation bar 200 to be described below is inserted into the main body through the main body air outlet 18.

In other words, the holding end part 122 of the lever bracket 100 may be installed to protrude to a position upper than the upper surface or end of the inner housing 11. Accordingly, the holding end part 122 of the lever bracket 100 may be configured to interfere with the end of the operation bar 200 to be described below.

The holding end part 122 may be formed to be biased to the left or right end of the extension piece 120. FIG. 8 illustrates the holding end part 122 formed to be biased to the right end of the extension piece 120.

The protrusion hole 112 receiving the mounting protrusion 57*a* may be formed vertically through the mounting piece 110. That is, the protrusion hole 112 may be formed in the front end of the mounting piece 110 (in FIG. 8), the protrusion hole having a shape corresponding to the shape of the mounting protrusion 57*a* of the latch 50. The mounting protrusion 57*a* may be inserted and held in such a protrusion hole 112.

A through hole 114 may be formed vertically through the mounting piece 110 as illustrated in FIG. 8.

The through hole 114 may be formed at a position corresponding vertically to the mounting hole 57*b* of the latch 50 described above and may have a size corresponding to the mounting hole 57*b*. The through hole 114 and the mounting hole 57*b* may be parts through which the fastener passes.

Figure 9:
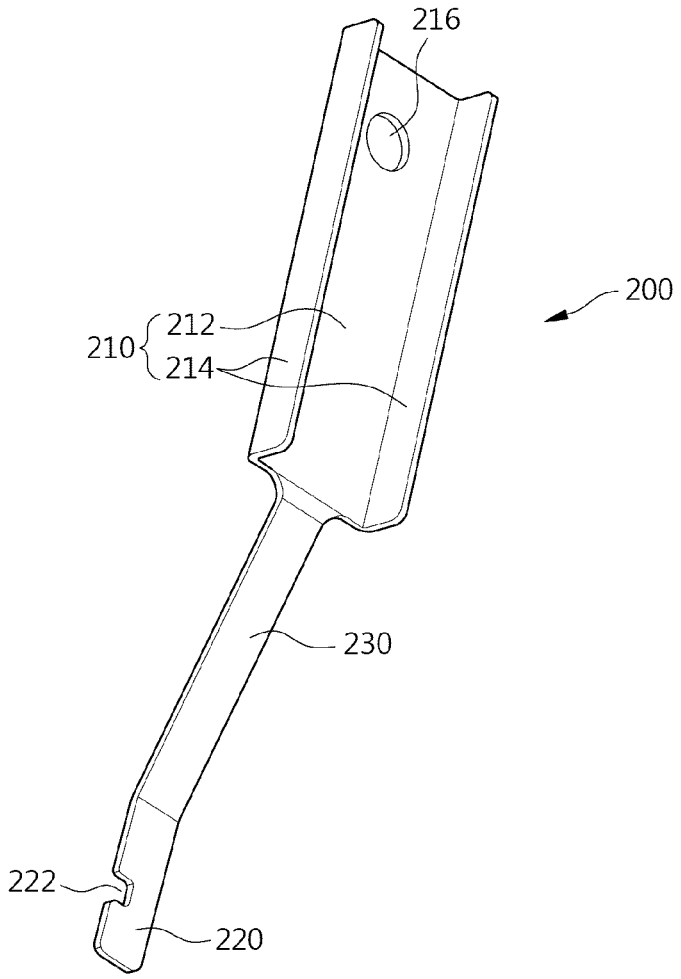
FIG. 9 is a perspective view illustrating the configuration of an operation bar according to the embodiment of the present disclosure.

FIG. 9 is a perspective view illustrating the configuration of the operation bar 200 by which a user located outside the main body 10 forces the rotation of the latch 50.

As illustrated in the drawing, the operation bar 200 may be configured to include: a handle 210 grasped by a user's hand; a holding piece 220 interfering with the holding end part 122 of the lever bracket 100; and a holding extension piece 230 formed between the handle 210 and the holding piece 220 and connecting the handle 210 to the holding piece 220 such that the handle 210 and the holding piece 220 are integrated with each other.

The handle 210 may be formed to have length corresponding to a width of a user's hand. The holding piece 220 may be formed at a position spaced apart from the handle 210 and may be a part interfering with the holding end part 122 of the lever bracket 100.

Specifically, as illustrated in FIG. 9, the holding extension piece 230 may be formed on the front end of the handle 210 such that the holding extension piece has a predetermined length, and the holding piece 220 may be formed to be integrated with the front end of the holding extension piece 230.

The holding extension piece 230 may be formed to have the same width and thickness as the holding piece 220.

An end part groove 222 may be formed in a surface of the holding piece 220 by being recessed toward the inner side thereof, the end part groove allowing an end of the holding end part 122 to be received therein. That is, as illustrated in FIG. 9, the end part groove 222 having a predetermined size may be formed in the left side surface of the holding piece 220 by being recessed rightward.

The end part groove 222 may be a part in which the holding end part 122 of the lever bracket 100 is received. Accordingly, the width of the end part groove 222 may have at least a size larger than the size of the thickness of the holding end part 122.

Meanwhile, the handle 210 and the holding piece 220 may be formed to be parallel to each other, and the holding extension piece 230 may be formed to incline, so the holding extension piece may be configured to connect the handle 210 and the holding piece 220 to each other which have heights different from each other.

Accordingly, the holding piece 220 may be formed at a position lower than the handle 210 by being spaced apart therefrom, and the holding extension piece 230 may be formed to incline and connect the holding piece 220 and the handle 210 to each other which have the different heights.

The handle 210 may include a main piece 212 having a predetermined area and edges 214 formed by extending after bending perpendicularly to the opposite ends of the main piece 212 therefrom.

The main piece 212 may be configured as a flat plate having a predetermined size, and the thickness of such a main piece 212 may have a size corresponding to the thickness of each of the holding extension piece 230 and the holding piece 220.

A storage hole 216 may be formed vertically through the rear end part of the main piece 212. The storage hole 216 may function to facilitate the hanging of the operation bar 200 on a hook or nail, or may function to facilitate the storage and portability of the operation bar by allowing a hanging mechanism such as a key ring to pass through the storage hole.

In addition, as described above, the operation bar 200 may interfere with the upper end of the lever bracket 100. That is, when the holding piece 220 of the operation bar 200 is inserted into the main body 10 through the main body air outlet 18, the holding piece 220 may interfere with the holding end part 122 of the lever bracket 100.

Figure 10:
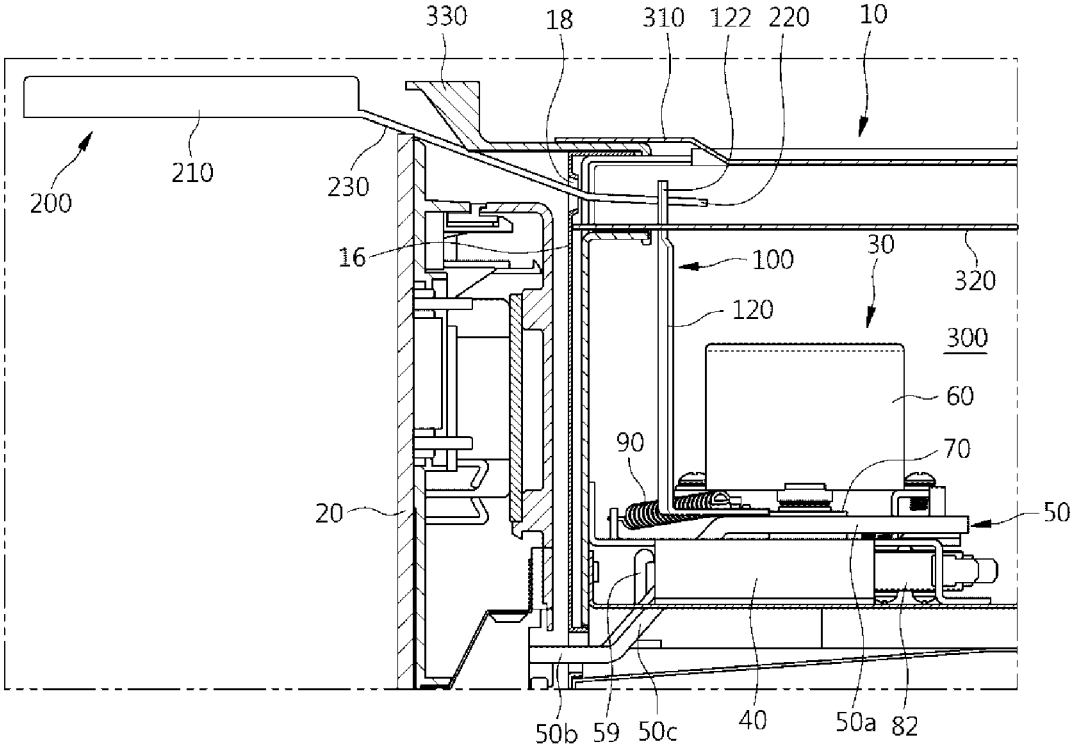
FIG. 10 is a partial side sectional view illustrating the opening state of the door by inserting the operation bar into a main body according to the embodiment of the present disclosure.
Figure 11:
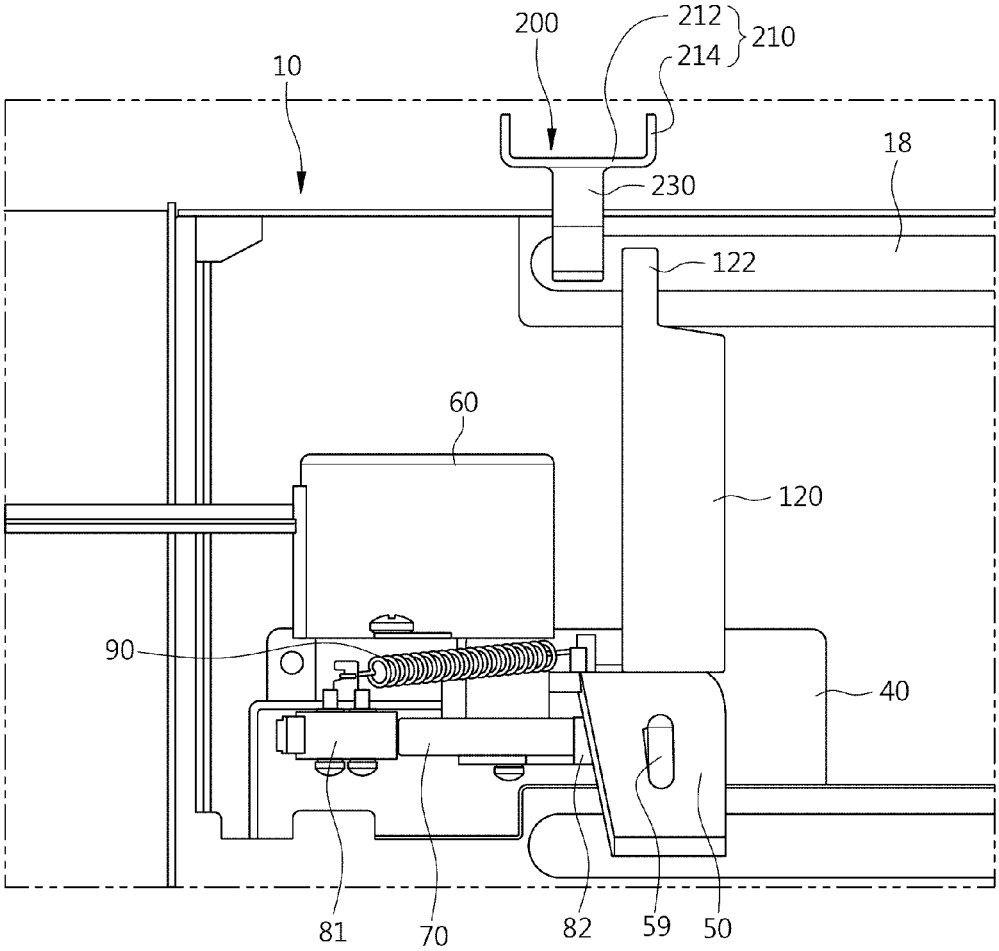
FIG. 11 is a partial front view of FIG. 10.
Figure 12:
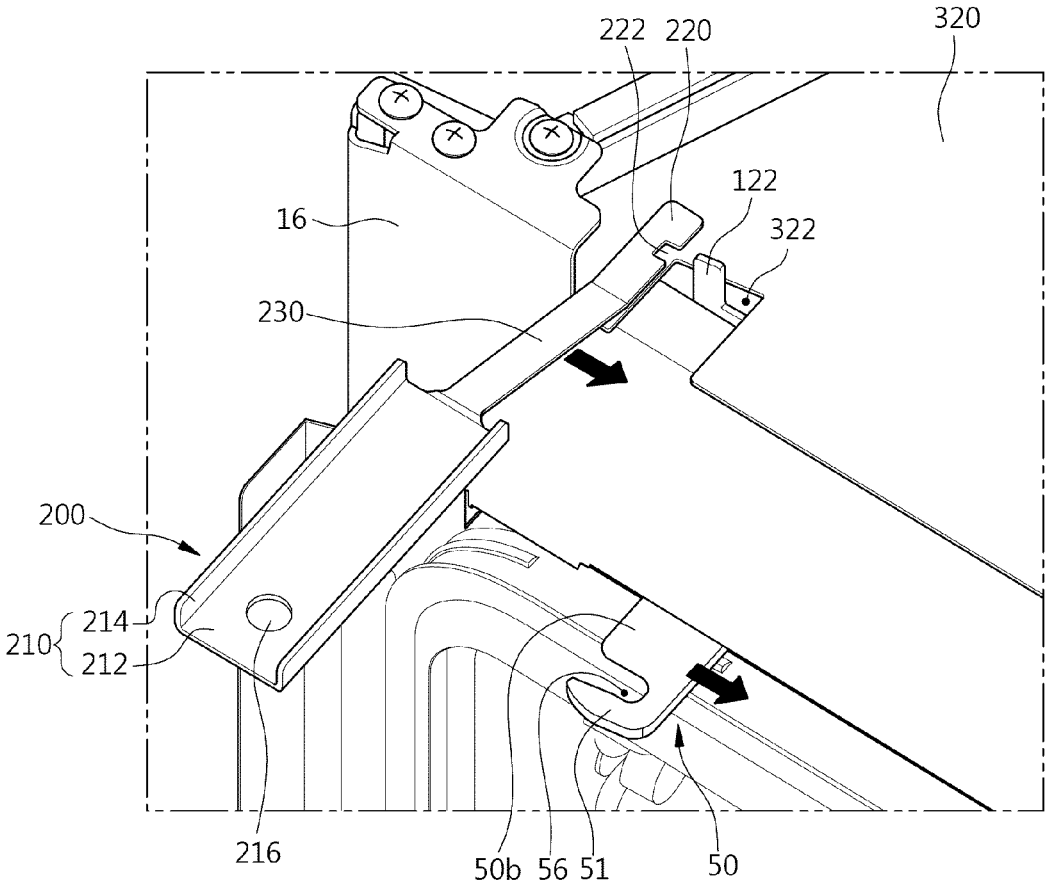
FIG. 12 is a partial perspective view of FIG. 10.

Hereinafter, the operation of the cooking appliance of the present disclosure having the above configuration will be described with reference to FIGS. 10 to 12. FIG. 10 is a partial side sectional view illustrating the opening state of the door 20 by inserting the operation bar 200 into a main body 10; FIG. 11 is a partial front view of FIG. 10; and FIG. 12 is a partial perspective view of FIG. 10.

As illustrated in these drawings, the latch module 30 may be mounted to the upper end part of the main body 10. That is, a machine room space 300 in which parts such as the latch module 30 and a blowing fan (not shown) are installed may be defined to have a predetermined size at the upper side of the cooking chamber of the main body 10, and the upper side of the machine room space 300 may be covered by an upper cover 310.

In addition, the partitioning piece 320 may be formed under the upper cover 310, and a flow path for an air flow may be formed between the partitioning piece 320 and the upper cover 310.

An upper decoration 330 may be provided in the front (a left side of FIG. 10) of the upper cover 310, and may be configured to shield the upper side of the door 20.

In this case, as illustrated in FIG. 10, the upper end of the lever bracket 100 constituting the latch module 30 may be exposed to the upper side of the partitioning piece 320. That is, the upper end of the holding end part 122 may pass through an exposure hole 322 formed vertically through the partitioning piece 320 and be exposed to the upper side of the partitioning piece 320.

Meanwhile, when a user inserts the holding piece 220 into the main body 10 through the main body air outlet 18 by holding the handle 210 of the operation bar 200 with the user's hand, as illustrated in FIG. 10, the holding piece 220 and the holding extension piece 230 of the operation bar 200 may be introduced through a gap between the upper end of the door 20 and the upper decoration 330, and the holding piece 220 may pass through the main body air outlet 18 and may be inserted into the main body 10.

In this case, as illustrated in FIGS. 11 and 12, the holding piece 220 of the operation bar 200 may be located at the left side of the holding end part 122 of the lever bracket 100.

In this state, when a user moves the operation bar 200 rightward, the lever bracket 100 may be pushed rightward by the operation bar 200, and the latch 50 coupled to the lever bracket 100 may be rotated counterclockwise (when viewed from above) relative to the rear end of the latch.

When the latch 50 is rotated counterclockwise (when viewed from above) relative to the rear end thereof, the front end of the latch 50 may be rotated rightward (in FIGS. 11 and 12). Accordingly, the pin of the door 20 (not shown) inserted to the hook groove 56 of the latch 50 may be removed from the hook groove 56.

When the pin of the door 20 (not shown) is removed from the hook groove 56, the door 20 may be unlocked and opened. Accordingly, in the state in which power is cut off, the door 20 may be manually unlocked by a user pushing the lever bracket 100 rightward by using the operation bar 200.

The scope of the present disclosure is not limited to the embodiment illustrated above, and within the technical scope as described above, many other modifications based on the present disclosure will be possible for those skilled in the art.

For example, in the embodiment described above, the mounting protrusion 57*a* may be formed on the latch 50, and the protrusion hole 112 may be formed in the mounting piece 110 of the lever bracket 100 such that the mounting protrusion 57*a* is inserted into the protrusion hole 112. Of course, the opposite is also possible. That is, the protrusion hole 112 may be formed in the latch 50, and the mounting protrusion 57*a* may be formed on the mounting piece 110.

What is claimed is:

1. A cooking appliance comprising:

a main body defining a cooking chamber configured to receive food to be cooked;

a door configured to rotate relative to the main body and to open and close the cooking chamber of the main body; and a latch assembly positioned at the main body and configured to allow the door to open and close the cooking chamber, wherein the latch assembly comprises:

a latch, an elastic body configured to apply an elastic force to the latch to thereby rotate the latch in a first direction, a driver configured to apply a driving force to the latch, the driver being configured to drive the latch to overcome the elastic force and rotate in a second direction that is opposite to the first direction, a cam configured to transfer the driving force from the driver to the latch, and a lever bracket that is connected to the latch and configured to transfer an external force to the latch to thereby rotate the latch, wherein the latch comprises:

an upper end part, a lower end part that is positioned at a different vertical height from the upper end part, and an inserting connection part that connects the upper end part to the lower end part, wherein the inserting connection part extends at an angle relative to the upper end part and the lower end part, wherein the main body comprises:

an inner housing defining the cooking chamber, and an outer housing surrounding the inner housing, and wherein an upper end of the lever bracket extends through an upper surface of the inner housing and is positioned at least partially above the upper surface of the inner housing.

2. The cooking appliance of claim 1, wherein the main body includes:

an inner housing defining the cooking chamber;

a main body panel positioned at an end part of the inner housing; and a main body air outlet defined at an end part of the main body panel and configured to discharge air from the main body to an outside of the main body;

wherein an upper end of the lever bracket is positioned to correspond to a height of the main body air outlet.

3. The cooking appliance of claim 1, wherein the lever bracket comprises:

a mounting piece coupled to the latch, and an extension piece extending from an end of the mounting piece at an angle relative to the mounting piece.

4. The cooking appliance of claim 3, wherein the mounting piece is mounted to a surface of the latch, and the extension piece is perpendicular to the mounting piece.

5. The cooking appliance of claim 4, wherein the lever bracket comprises:

a holding end part extending from an end of the extension piece and having a width smaller than a width of the extension piece.

6. The cooking appliance of claim 5, wherein the main body includes:

an inner housing defining the cooking chamber;

a main body panel positioned at an end part of the inner housing; and a main body air outlet defined at an end part of the main body panel and configured to discharge air from the main body to an outside of the main body;

wherein the holding end part of the lever bracket is positioned to correspond to a height of the main body air outlet.

7. The cooking appliance of claim 5, wherein the main body comprises:

an inner housing defining the cooking chamber, and an outer housing surrounding the inner housing, wherein the holding end part of the lever bracket extends through an upper surface of the inner housing and is positioned at least partially above the upper surface of the inner housing.

8. The cooking appliance of claim 1, wherein the lower end part is spaced vertically and horizontally apart from the upper end part.

9. The cooking appliance of claim 8, wherein the upper end part and the lower end part are positioned parallel to each other.

10. The cooking appliance of claim 1, wherein the latch defines a hook groove at an end of the lower end part, the hook groove configured to receive a pin of the door.

11. The cooking appliance of claim 10, wherein the hook groove defines a holding surface configured to hold the pin of the door therein or configured to allow the pin of the door to contact and slide on the holding surface.

12. The cooking appliance of claim 11, wherein the holding surface comprises:

a locking surface defined at an inner side of the hook groove, and a removal inclination surface defined at an exit side of the hook groove.

13. The cooking appliance of claim 12, wherein the latch includes a removal prevention step that protrudes from an end of the removal inclination surface and that is configured to restrict the pin of the door from being removed from the hook groove.

14. The cooking appliance of claim 13, wherein the latch includes a movement-prevention protrusion that protrudes from a surface of the inserting connection part and that is configured to restrict an upward movement of the latch.

15. The cooking appliance of claim 3, wherein the latch defines a mounting protrusion, and wherein the mounting piece of the lever bracket defines a protrusion hole that corresponds to the mounting protrusion of the latch and configured to couple the mounting protrusion of the latch.

16. The cooking appliance of claim 15, wherein the latch defines a mounting hole, and wherein the mounting piece of the lever bracket defines a through hole configured to align with the mounting hole and vertically receive a fastener through the mounting hole and the through hole.

17. The cooking appliance of claim 1, wherein the lever bracket is configured to move and guide the latch to rotate based on an operation bar being inserted into the main body from an outside of the main body.

18. The cooking appliance of claim 17, wherein the operation bar is configured to engage with an upper end of the lever bracket.

* * * * *